United States Patent [19]

De Matteis et al.

[11] Patent Number: 4,909,636

[45] Date of Patent: Mar. 20, 1990

[54] COUPON FOR T-SHIRT GROCERY BAG

[75] Inventors: Robert B. De Matteis, San Jose, Calif.; Wayne A. Pflueger, Salt Lake City, Utah

[73] Assignee: Cupples Paper Bag Company, LaMirada, Calif.

[21] Appl. No.: 185,633

[22] Filed: Apr. 26, 1988

[51] Int. Cl.[4] ..... B65D 33/10

[52] U.S. Cl. ..... 383/8; 381/10; 229/70

[58] Field of Search ..... 383/8, 7, 9, 10, 37, 383/33; 229/70

[56] References Cited

U.S. PATENT DOCUMENTS

| | | | |
|---|---|---|---|
| 3,220,634 | 11/1965 | Rubinstein | 229/70 |
| 4,417,609 | 11/1983 | Sherwood | 383/33 |
| 4,613,988 | 9/1986 | Maddock | 383/8 |
| 4,733,817 | 3/1988 | Makowka | 3283/5 |

*Primary Examiner*—Willis Little

*Attorney, Agent, or Firm*—Townsend and Townsend

[57] ABSTRACT

A plastic grocery bag is provided with a tear-off coupon. The coupon is configured with the rest of the bag for rapid production and easy detachment from the bag. The plastic bag is fabricated from tubes of blown plastic. The tube is first collapsed and printed and thereafter folded at the side edges to form two "W" shaped folds along the bag sides. These folds permit the bag, when expanded, to accommodate the required containment volume. As a next step, the folded tube is both heat-sealed and cut to form sealed incremental folded tubes. These tubes are in turn cut at the bottom to form the bottom of the bag and at the top to form the paired handles on either side of an opening, which handles are characteristic of the T-shirt bag. Centrally of the top of the two handles, and for the purpose of holding a group of such bags together, there is configured on the forward wall and rearward wall of each bag a tab. When numerous bags overlie one another, the tabs of all the overlying bags may be joined together into a wicket. This wicket holds the overlying bags stacked as a group together. This wicket also allows the bags to be serially opened and filled with merchandise, typically at a check stand. The improved coupon of this bag is configured from material that would otherwise be cut from the vicinity of the bag opening when it is formed. Specifically, the coupon is printed and cut for placement between the folded "W" folds at the sides. The coupon is configured so as not to interfere with the tab. With these positioning constraints, the coupon is placed for each detachment by either a packing clerk or the toting shopper without otherwise damaging or interfering with overall functionality of the bag.

1 Claim, 3 Drawing Sheets

COUPON FOR T-SHIRT GROCERY BAG

BACKGROUND OF THE INVENTION

This invention relates to bags. More specifically, this invention relates to an apparatus and process for manufacturing a plastic T-shirt bag with an integral coupon.

SUMMARY OF THE PRIOR ART

The manufacture and use of so-called "T-shirt" plastic grocery bags has surprising complexity. The process of manufacture of these bags will first be described. Thereafter, the use of the bags will be set forth—with emphasis on how the bags are dispensed and filled. It is only after this relatively complex prior art environment is understood that the enclosed disclosure relating to the placement of coupon on the bags can be set forth and understood. Accordingly, a summary of a typical prior art bag manufacture is given here. The reader will understand that the steps and their sequence is by way of typical example. Variation occurs.

First, T-shirt bags start as blown tubes of plastic. These blown tubes of plastic are produced in a prior art process that need not be repeated here. This tube is cooled so that the plastic side walls are no longer in a molten or sticky state. Thereafter. the sides of the tubes are collapsed upon themselves. After collapse a continuous spiral roll is formed from the collapsed tubes.

Second, the collapsed tubes are imprinted with information—such as store identity or advertising thereon.

Third, the printed tube is folded at its side edges with a "W" fold. This "W" fold can be additionally described as a gusset fold.

The so-called "gusset fold" is easy to understand. In order that the bag can be expanded to form the content receiving volume, provision must be made for the front bag wall and the rear bag wall to move apart. When each side of the tube is folded with a "W" fold by bending the tube in at its sides and collapsing and pressing the tube as bent room for expansion is provided for the ultimately manufactured bag.

Assuming that the bag is in the collapsed position this leaves the bag at the side edges with four discrete layers of material. These layers of material are the front side wall of the bag two folds forming the sides of the bag, and a rear wall forming the back side edge of the bag. The reader will understand that by folding the side edges in upon themselves, the tube is ready to be formed into bags that ultimately can be expanded.

Fourth, the bag is sealed and cut. The sealing is accomplished by typically tow horizontally disposed closely spaced seals, one seal typically forms the bottom of the bag for holding the contents. The second, closely spaced seal also forms the top of another bag.

The cutting of the top of the bag has two discrete functional steps.

First, the continuous tubing is cut between the two closely spaced seals. It is cut so that the top of one bag and the bottom of another bag are formed between the adjacent closely spaced seals.

Second, the bag is cut at the top in what is sometimes referred to as a "cut out" operation. This cut out forms the opening of the bag as well as three components of the bag top. These three components are the two bag handles and a tab in the central portion of the bag.

The handles have obvious function. They permit the bag when filled to be toted by the user.

The tab has another function. Specifically when many bags are overlayed one upon another, the tabs of the many bags likewise overlie one another. These tabs are fused together to form a wicket. This fused wicket permits the overlying bags as a group to be mounted to a stand and thereafter vended serially.

The bags, handled as a group, are familiar to anyone who has frequented a grocery store having a shopping clerk load plastic grocery bags. The entire group of bags is mounted at their wicket to a bag dispensing rack. The bags are dispensed from the rack one at a time. Typically. the front wall of each bag to be dispensed is pulled free of its tab. When the front wall moves forward free of its tab, the bag opens—with the back wall of the bag still held to the back of the dispensing rack at its tab. The bag is filled in this disposition, typically with grocery items after they have been checked. When the bag is filled and removed from the rack, the back wall of the bag tears free from its tab. The grocer typically loads and/or hands the bag to the shopper by grasping it at the handles. Ultimately, the bag when grasped at the handles, with its contents leaves the store with the shopper. The tabs remain on the bag rack as the leftover wicket.

The material from which such bags are made has its own limitations. Typically, the material easily tears in either the horizontal or vertical directions. The material resists tear off on a bias with respect to the horizontal or the vertical.

Tear off coupons in themselves are well known. They are found prolifically in boxes, conventional paper bags and appended to grocery counters in tear-off pads—among many other places. To date, because of the complexity of the manufacturing process and the use of plastic bags, tear off coupons have not found their way into the natural advertising environment furnished by such bags.

SUMMARY OF THE INVENTION

A plastic grocery bag is provided with a tear-off coupon. The coupon is configured with the rest of the bag for rapid production and easy detachment from the bag. The plastic bag is fabricated from tubes of blown plastic. The tube is first collapsed and printed and thereafter folded at the side edges to form two "W" shaped folds along the bag sides. These folds permit the bag, when expanded, to accommodate the required containment volume. As a next step, the folded tube is both heat-sealed and cut to form sealed incremental folded tubes. These tubes are in turn cut at the bottom to form the bottom of the bag and at the top to form the paired handles on either side of an opening, which handles are characteristic of the T-shirt bag. Centrally of the top of the two handles, and for the purpose of holding a group of such bags together, there is configured a detachable tab on the forward wall and rearward wall of each bag. When numerous bags overlie one another, the tabs of all the overlying bags may be joined together into a wicket. This wicket holds the overlying bags stacked as a group together. This wicket also allows the bags to be serially opened and filled with merchandise, typically at a check stand. The improved coupon of this bag is configured from material that would otherwise be cut from the vicinity of the bag opening when it is formed. Specifically, the coupon is printed and cut for placement between the folded "W" folds at the sides. The coupon is configured so as not to interfere with the tab. With these positioning constraints, the coupon is placed for easy detachment by either a packing clerk or the toting shopper without otherwise damaging or interfering with overall functionality of the bag.

Other Objects, Features, and Advantages

It is an object to this invention to disclose a process for the manufacture of coupons that does not interfere appreciably with the mass production of such bags nor their use. Accordingly, a process of manufacture of the bags and an article of manufacture is disclosed wherein the coupon is disposed at the opening of the bag between the gusset or "W" folds free and clear of the tabs forming the wicket. In this location, at least one imprinted coupon can be individually dispensed without interference with either the process of bag manufacture or ultimate use of the bag.

BRIEF DESCRIPTION OF THE DRAWINGS

Other objects, features, and advantages will become more apparent after referring to the following specification and attached drawings in which:

Referring to FIG. 1, a single bag is illustrated in accordance with this invention. The bag B has a front wall 14 and rear wall 16. Rear wall 16 may be seen above a bottom seal 20 in a part of the picture that has been cut away for the convenience of the viewer.

Figure 1:
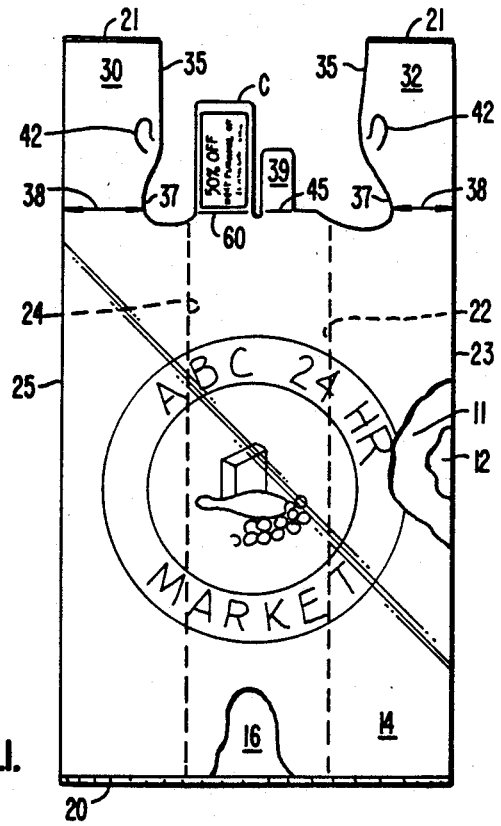
FIG. 1 is a perspective view of a single bag fabricated in accordance with the preferred embodiment of this invention illustrating a single coupon and single tab forming wicket.

Two gusset fold boundaries 22 and 24 are illustrated. These boundaries 22 and 24 form the limits of folds at the side edges of the bag. The W folds extend from fold limit 22 to side edge 23 and from fold limit 24 to side edge 25 of bag B.

It will be understood that between limits 22, 24 and the adjacent side edges of the bag 23, 25, the bag is four layers thick. The first layer is the front of the bag 14. The second layer is a first portion of the side of the bag 11. The third layer is the second portion of the side of the bag 12. The final layer is the back 16 of the bag.

The bag as fabricated has a bottom seal 20 and a top seal 21. Bottom seal 20 forms the bottom of the bag. Without this seal, bag contents would fall out the bottom.

The top seal at 21 joins the bag wall together to form ultimately the two, handles 30, 32 together. Handles 30, 32 permits a shopper to tote the bag conveniently when its interior volume has been filled with contents.

The bag must be cut to define an opening. This cut includes two vertical handle cuts 35 and two handle neck cuts 37. Handle neck cuts 37 typically undercut 35 so that the narrowest portion of each handle occurs at area 38. At the same time, it will be seen that the arcuate cut 37 configures handle 32 on front wall 14 and handle 32 on rear wall 16. These same cuts 37 also configure the junction between side walls 11, 12. This cut has been found to prevent bag side wall tearing.

For convenience in dispensing the bag, there are provided two dog ear cuts 42. Dog eared cuts 42 permit threading of the handles 30, 32 to grocery racks handles 40, 42. In this configuration, bags can be dispensed as will hereinafter be set forth. Further, these dog eared cuts serve to keep handles 30, 32 together when bags B are handled as a group.

There is defined a tab 39. Tab 39 has scoring 45 at the bottom of the tab. The purpose of tab 39 can be easily understood.

Figure 2:
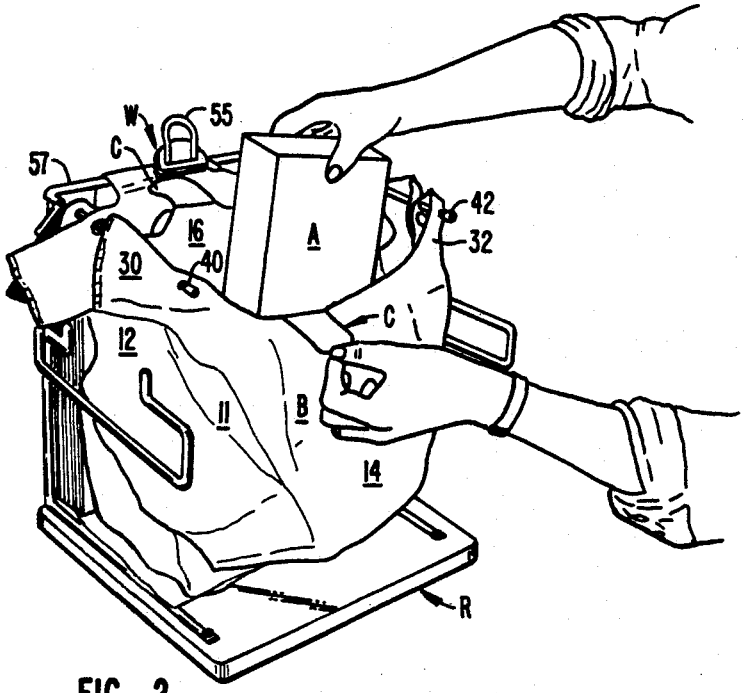
FIG. 2. is a perspective view of a batch of bags supported upon a rack having one bag being dispensed, filled with articles, and showing the clerk removing the coupon for handing to the customer.

With quick reference to FIG. 2. it can be seen that a group of bags are mounted by a wicket W to a grocery rack. Wicket W is formed from tabs 39 when a number of bags (typically in the order of 100) are laid overlying one another. Tabs 39 are fused to form the unitary wicket W.

In this invention, the coupon C is placed. Coupon C is formed between fold edges 22, 24. It is placed in a location where it does not interfere with tab 39 nor the ultimately formed wicket W. It is this placement which enables the coupon to be used in this environment.

Use of the bags B is easily understood. Typically a group of such bags are mounted to a rack R at wicket W at a wicket receiving stanchion 55. Stanchion 55 includes a U-shaped arm 57 having protruding bars 40, 42. Bars 40, 42 are threaded at ears 40, 42 of handles 30, 32. Typically the front wall 14 is pulled forwardly into rack R. This pulls front wall 14 away from rear wall 16 and causes the folded side edges 11, 12 on each side of the bag to expand. In this disposition, articles A are loaded by a grocery clerk into the bag.

As configured herein, it can be seen that the coupon C is readily severed at its bottom scoring 60 from the front bag wall 14. It will be noted that an identical tab of material C protrudes from rear bag wall 16. This material may alternatively either be left blank or comprise in itself a coupon.

It will be observed that coupon C does not intrude into either of the two side "W" folds. Specifically, the coupon is not configured between fold limit 24 and side edge 25 nor fold limit 22 and side edge 23. This placement enables the coupon to be cooperatively formed with the rest of the bag.

Figure 3:
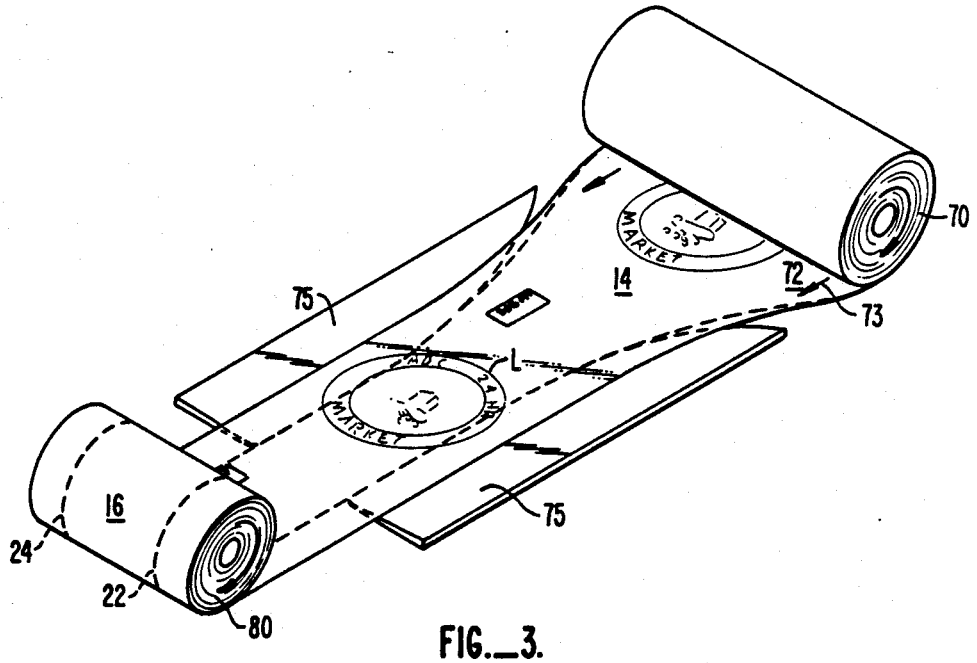
FIG. 3 is a schematic of printed tubing material having the coupon imprint thereon, the imprinted material being dispensed from a spiral wound roll and having a "W" fold applied at the corners.
Figure 4:
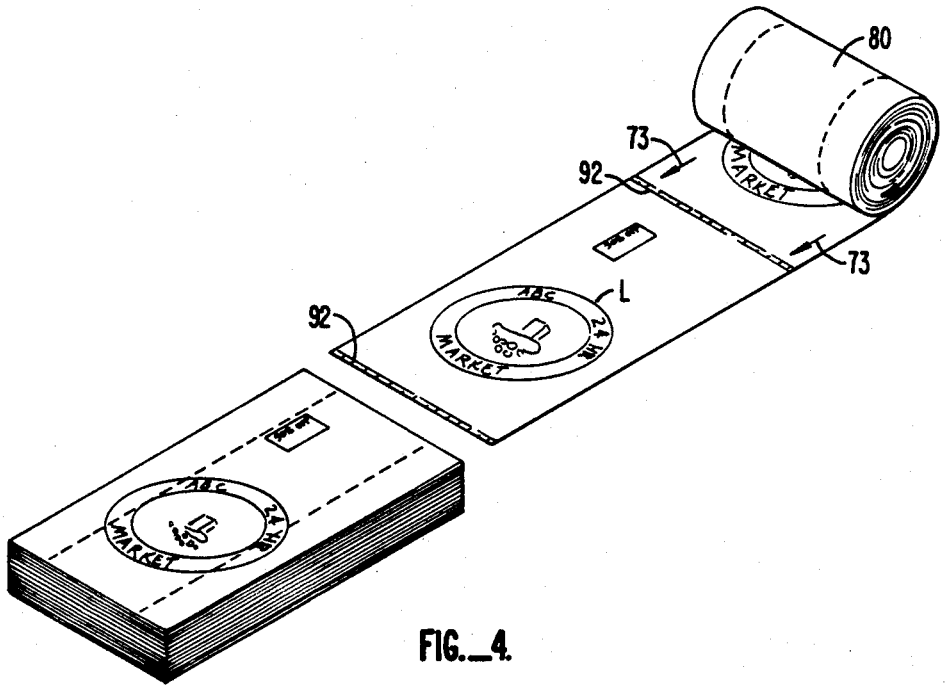
FIG. 4 is an illustration of the bag roll accumulated at FIG. 3 illustrating schematically the sealing and severing of the sequential bags.
Figure 5:
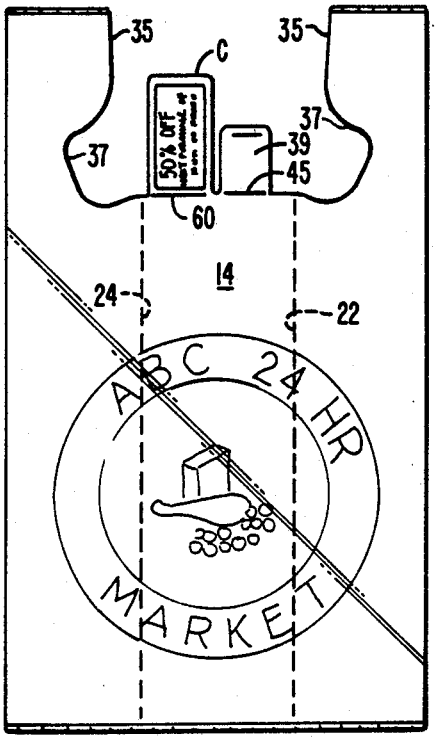
FIG. 5 is a continuation of the schematic of FIG. 4 illustrating the cutting of the top portion of the bag to define both the tab for forming a wicket for joining multiple bags as well as the coupon of this invention; and, FIG. 6 is a view of an alternate embodiment of this invention having two handle tabs for forming two bag joining wickets with the illustrated coupon shown placed therebetween.

Referring to FIGS. 3, 4, and 5, the schematic process for the fabrication of the bag is illustrated. The reader should understand that the specific equipment utilized of this formation is well known in the prior art. These schematics are provided so the reader can understand how the placement of the coupon configures with the manufacture of the bag.

Referring to FIG. 3, an imprinted bag roll 70 is shown dispensing an endless folded tube of bag material 72. Endless fold 72 is dispensed in the directions of arrow 73.

The material of spiral roll 70 has previously been imprinted. It has been imprinted as a collapsed double layer folded endless tube. That is to say, the material of the bag when imprinted does not include the two side edge "W" folds.

It can be seen that the bag includes imprinting L for a store logo. Additionally. a coupon (labeled 50% off) has been imprinted on the bag. This imprint is here shown on the front bag wall 14 overlying the logo L in a location that will ultimately be between the respective W folds in the bag.

Folding edges 75 are schematically shown. These edges typically cause the side edges of the tube material to fold in upon themselves. As folding in and upon themselves, a second roll of bag material 80 is formed in a spiral wind. This bag material includes the side edges 22, 24. Thus, after this process, the side edges of the bag are four layers thick with the central portion being two layers thick.

Referring to FIG. 4, the next sequential step in the manufacture of the bag is illustrated. Specifically, the bag material is conveyed from spiral roll 80 in the direction of arrow 73. The bag material is conveyed past a sealing apparatus (not shown but well known in the prior art) where respective seals 92 are placed in the bag. Thereafter, or simultaneously and intermediate of each of the seals, the bag is sequentially cut (by apparatus well known in the prior art and not shown). When a cut at each seal occurs, the severed portions of the seal respectively form the top of one bag and the bottom of another bag.

Referring to FIG. 5, the cutting of opening of the bag can now be set forth. Specifically the top of each bag is cut. It is cut with vertical cuts 35 arcuate cuts 37 so as to form the bag opening and the two handles.

It can be seen that vertical cuts 35 are inside of the respective W fold boundaries 24, 22. In this way they form the familiar loop handles of such bags.

A tab 39 with a respective tab scoring or precut 45 is placed on each bag. As is heretofore been set forth. tab 39 will ultimately form the wicket W. Coupon C has also been cut. Coupon C has its own scoring 60 at the bottom thereof. Preferably scoring 60 is placed in the horizontal to be within a convenient tear plane of the material of bag B. The coupon C is cut so as to overlie the imprinted indicia here shown as the words "50% off". A single bag is thus cut and prepared.

Referring back to FIG. 4, it can be seen that the individually cut bags are stacked precisely overlying one another. This cutting and stacking enables the tabs 39 to be joined at the wicket W as shown in FIG. 2.

It will be noted that two coupons are simultaneously formed. One coupon is formed from the front wall 14. A second coupon is formed from the rear wall 16 (not shown in FIG. 5). In accordance with this disclosure, both of the formed coupons C can either be imprinted or one may be left blank.

It will be seen that the scoring 60 is preferably in a horizontal plane. In this horizontal plane, it is not at the point of initiation of either vertical or horizontal tears (other than for the original severance of the coupon). As such the coupon does not promote bag wall tearing.

At the same time, the coupon is easily imprinted and dispensed as an integral part of the bag manufacture.

The reader will understand that in accordance with this disclosure, the coupons must be formed between the fold boundaries 24 and 22 from the front walls 14 and rear wall 16 of the bag.

Figure 6:
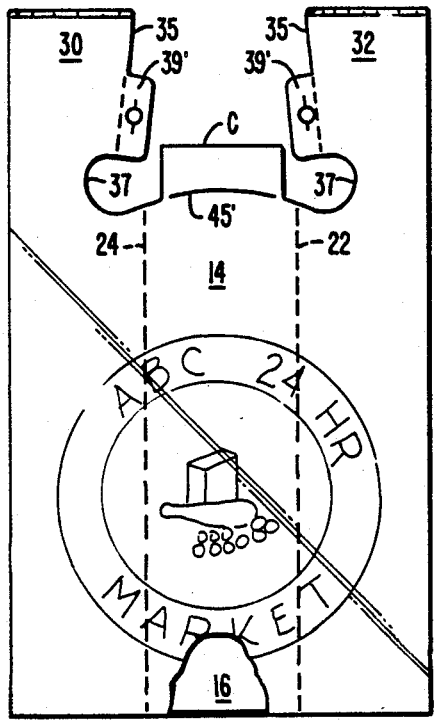

Referring to FIG. 6. an alternate embodiment of this invention is shown. In FIG. 6, paired tabs 39 are formed in the handles 30, 32 between the vertical cut 35 and the arcuate cut 37 at the bag handles. Formation occurs by a process which is precisely identical to that previously illustrated.

The coupon, C', is formed in the same location that the tab 39 was ultimately formed. Location of imprinting for the coupon information has been correspondingly altered. A horizontal prescore 45' has been provided.

Again, it can be seen that the coupon has been formed at the bag opening between the respective fold limits 22, 24 in an area that is free of the tabs 39'. Interference of the coupon with a ultimately formed wicket W will not occur.

What is claimed is:

1. A process of forming a coupon and a plastic bag comprising the steps of: imprinting a collapsed endless tube with coupon indicia adjacent the intended opening of said bag, said coupon indicia being disposed centrally of said endless tube;

imparting a "W" fold to said imprinted collapsed endless tube, said imparted W fold being to the side edge of said bag and not under said imprinted coupon indicia;

sealing and severing said bag to form a sealed bottom and a sealed top;

cutting said top with at least one tab therebetween to form an opening in said bag and to define the two handles of said bag;

defining during said cut at least one detachable coupon overlying said coupon imprinted indicia between said handles free of said tab and between the boundaries of said "W" folds whereby said bag is formed with a severable coupon.

* * * * *